US010529483B2

(12) United States Patent
Yang

(10) Patent No.: US 10,529,483 B2
(45) Date of Patent: Jan. 7, 2020

(54) RESONANT TRANSFORMER WITH ADJUSTABLE LEAKAGE INDUCTANCE

(71) Applicant: YUJING TECHNOLOGY CO., LTD., Taoyuan (TW)

(72) Inventor: Sen-Tai Yang, Taoyuan (TW)

(73) Assignee: Yujing Technology Co., Ltd., Taoyuan (TW)

( * ) Notice: Subject to any disclaimer, the term of this patent is extended or adjusted under 35 U.S.C. 154(b) by 230 days.

(21) Appl. No.: 15/497,272

(22) Filed: Apr. 26, 2017

(65) Prior Publication Data

US 2018/0254143 A1 Sep. 6, 2018

(30) Foreign Application Priority Data

Mar. 1, 2017 (TW) ..... 10106655 A

(51) Int. Cl.

| | |
|---|---|
| ***H01F 27/30*** | (2006.01) |
| ***H01F 38/08*** | (2006.01) |
| ***H01F 27/32*** | (2006.01) |
| ***H01F 38/10*** | (2006.01) |
| ***H01F 13/00*** | (2006.01) |
| ***H01F 27/245*** | (2006.01) |

(52) U.S. Cl.

CPC ..... *H01F 38/08* (2013.01); *H01F 13/006* (2013.01); *H01F 27/245* (2013.01); *H01F 27/325* (2013.01); *H01F 38/10* (2013.01)

(58) Field of Classification Search

CPC ..... H01F 27/35; H01F 27/36; H01F 27/292; H01F 2027/2819; H01F 27/3346

USPC ..... 336/196, 197, 198, 220, 221

See application file for complete search history.

(56) References Cited

U.S. PATENT DOCUMENTS

| | | | | |
|---|---|---|---|---|
| 7,271,691 | B2 * | 9/2007 | Gu | H01F 27/326 336/182 |
| 8,395,470 | B2 * | 3/2013 | Lin | H01F 27/324 336/196 |
| 8,643,459 | B2 * | 2/2014 | Eom | H01F 27/30 336/196 |
| 8,791,786 | B2 * | 7/2014 | Maeda | H01F 5/00 336/136 |
| 8,922,322 | B2 * | 12/2014 | Lin | H01F 27/2847 336/182 |
| 9,105,390 | B2 * | 8/2015 | Yang | H01F 27/24 |

(Continued)

*Primary Examiner* — Alexander Talpalatski
*Assistant Examiner* — Joselito S. Baisa
(74) *Attorney, Agent, or Firm* — Alan D. Kamrath; Mayer & Williams PC

(57) ABSTRACT

A resonant transformer with adjustable leakage inductance includes a secondary winding group, a primary winding group, a magnetic sheet and a core group. The primary winding group is provided on a bobbin of the secondary winding group, and the magnetic sheet is provided in the bobbin. The secondary winding group, the primary winding group and the magnetic sheet include a first through hole, a second through hole and a through hole, respectively. The core group includes a first core and a second core symmetrically disposed, which are disposed on top of and at the bottom of the primary winding group, respectively. During operation of the resonant transformer, the degree of coupling between the primary and secondary sides can be changed using the magnetic sheet. This allows the native leakage inductance to be altered to satisfy demands for various different resonant frequencies.

6 Claims, 6 Drawing Sheets

(56) References Cited

U.S. PATENT DOCUMENTS

| | | | | |
|---|---|---|---|---|
| 9,349,521 | B2 * | 5/2016 | Tsai | H01F 27/28 |
| 2002/0057178 | A1 * | 5/2002 | Timashov | H01F 27/2804 336/208 |
| 2002/0067237 | A1 * | 6/2002 | Nakata | H01F 27/29 336/212 |
| 2007/0057757 | A1 * | 3/2007 | Chen | H01F 27/2866 336/212 |
| 2012/0001716 | A1 * | 1/2012 | Park | H01F 27/325 336/221 |
| 2016/0064134 | A1 * | 3/2016 | Yeo | H01F 27/22 336/61 |

* cited by examiner

RESONANT TRANSFORMER WITH ADJUSTABLE LEAKAGE INDUCTANCE

BACKGROUND OF THE INVENTION

1. Field of the Invention

The invention relates to a resonant transformer, more particularly, a resonant transformer with adjustable leakage inductance and used as a demagnetizing transformer at very low leakage inductance.

2. Description of the Prior Art

In power supply systems for electronic products such as LCD TV, LLC architecture offering high efficiency and easy production has become increasingly popular. The use of the leakage inductance inherently brought by the main transformer in lieu of an external resonant inductor further simplifies the LLC architecture and has been widely adopted. The inherent leakage inductance of the integrated LLC transformer being used as a resonant inductor eliminates the need for an additional inductor component on the circuit, thereby reducing power consumption and improving efficiency. Moreover, zero voltage switching (ZVS) of the LLC architecture further reduces switching loss and noise.

Leakage inductance is generated as a result of the coupling coefficient between the primary winding and the secondary winding of the transformer being less than one, such that a portion of the winding does not effectively perform the transformation of an electrical energy, and the inductance produced by this portion of the winding is the leakage inductance. The basic formula of a resonant transformer is $\omega=1/\sqrt{(LC)}$, wherein $\omega$ is the angular frequency of the power supply, L and C are the inductance and capitance of the LLC resonant tank, respectively. The resonant frequency f is often set differently according to different applications. In order to satisfy the needs for different resonant frequencies f, L and C must be adjustable. In order to precisely find a resonant point, parameters also require stepless fine-tuning. However, in actual implementations, this is not possible. Therefore, current resonant transformers typically use variable-frequency power supply as the power supply in order to adjust the value of $\omega$, but Lk cannot be adjusted from the inside of the resonant transformer. As a result, the efficiency of the resonant transformer cannot be enhanced.

Improvement in the structures of the resonant transformers have been proposed to create more leakage inductance, such as those described in, for example, TW Patent Publication No. M333646 titled "Improved Structure of Leakage Inductance Resonant Transformer", TW Patent Publication No. M416553 titled "Resonant Transformer Structure", and a TW Patent Publication No. "I556273 titled "Resonant High Current Density Transformer" filed by the present inventors. However, such kind of resonant transformers are constrained by physical limits, such as their sizes and weights. Therefore, under the constraints of a fixed volume, size or coil ratio, the leakage inductance cannot be adjusted at ease. This fails to satisfy the different power requirements of various power supply systems. Moreover, since manufacturers often need to create a variety of leakage inductances to satisfy the requirements of different power supply systems using the same structure, the range in which the leakage inductance can be adjusted is often limited, and circuit compromises are often made in existing transformers, and the performance of the resonant transformers cannot be efficiently improved.

In view of the above drawbacks of the conventional techniques, the inventors endeavored to find a solution and have finally come up with the present invention to address the aforementioned shortcomings.

SUMMARY OF THE INVENTION

One main objective of the present invention is to provide a resonant transformer with adjustable leakage inductance.

Another objective of the present invention is to provide a resonant transformer with adjustable leakage inductance in which a magnetic sheet can be swapped.

Still another objective of the present invention is to provide a resonant transformer with adjustable leakage inductance that acts as a demagnetizing transformer at very low leakage inductance.

In order to achieve the above objectives and efficacies, a resonant transformer with adjustable leakage inductance of the present invention includes: a secondary winding group including a bobbin having a first through hole; a primary winding group provided on the bobbin of the secondary winding group including a second through hole in communication with the first through hole; a magnetic sheet provided in the bobbin of the secondary winding group including a through hole in communication with the first and second through holes; and a core group including a first core and a second core symmetrically disposed, the first core being disposed on the top of the primary winding group, the second core being disposed at the bottom of the primary winding group, wherein the primary winding group is provided on the secondary winding group, and after the first and second cores are disposed on the top and bottom, during operation of the resonant transformer, leakage inductance of a required magnitude is created by the magnetic sheet.

Based on the above structure, a sidewall is provided at each of two ends on one side of each of the first and second cores, a protrusion is disposed between the sidewalls of each of the first and second cores, and the protrusions penetrate the first through hole, the second through hole and the through hole.

The above structure further includes two clips, each of which including a hook at each of two ends thereof, and a recess being provided at each of two ends on the other side of each of the first and second cores, wherein the hooks of the clips are engaged with the recesses of the first and second cores.

Based on the above structure, a wall plate is provided around the periphery of the top of the bobbin of the secondary winding group, a receiving space is formed between the wall plate and the top of the bobbin, the magnetic sheet and the primary winding group are received in the receiving space.

Based on the above structure, a plurality of positioning columns are provided at the bottom of the wall plate, and a plurality of positioning notches are correspondingly provided around the periphery of the magnetic sheet.

Based on the above structure, a slot is provided in the bobbin of the secondary winding group, and the magnetic sheet is disposed inside the slot.

Based on the above structure, a plurality of positioning columns are provided inside the slot, and a plurality of positioning notches are correspondingly provided around the periphery of the magnetic sheet.

Based on the above structure, a wall plate is provided around the periphery of the top of the bobbin of the secondary winding group, a receiving space is formed between the wall plate and the top of the bobbin, and a slot is provided in the bobbin of the secondary winding group, and the magnetic sheet is disposed inside both the slot the the receiving space.

Based on the above structure, a plurality of positioning columns are provided at the bottom of the wall plate and inside the slot, and a plurality of positioning notches are correspondingly provided around the periphery of the magnetic sheets.

Based on the above structure, the aperture of the through hole of the magnetic sheet is inversely proportional to the leakage inductance created in the resonant transformer; the thickness of the through hole of the magnetic sheet is proportional to the leakage inductance created in the resonant transformer; and the permeability of the through hole of the magnetic sheet is proportional to the leakage inductance created in the resonant transformer.

The objectives, efficacies and features of the present invention can be more fully understood by referring to the drawing as follows:

DETAILED DESCRIPTION OF THE PREFERRED EMBODIMENTS

Figure 1:
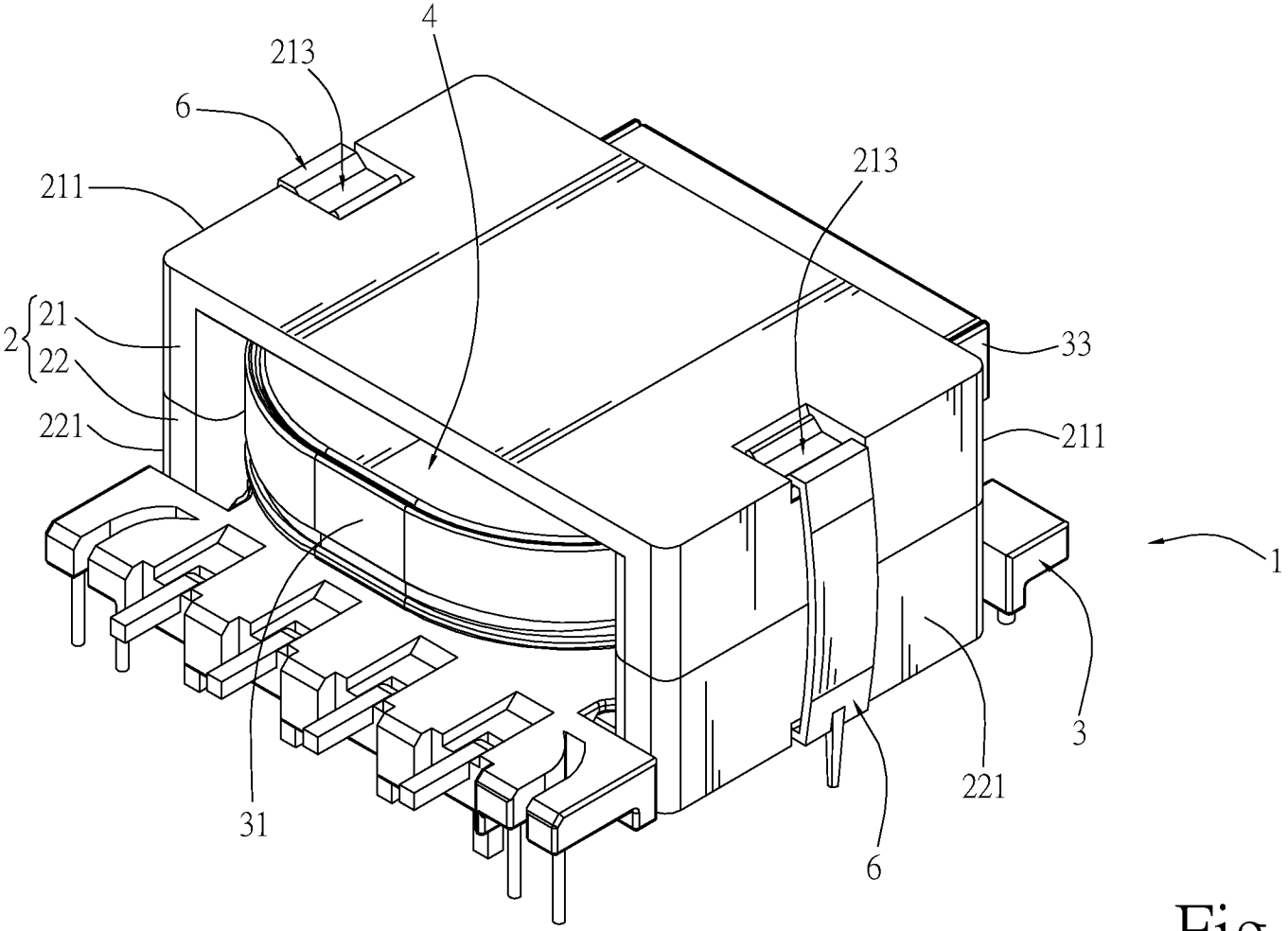
FIG. 1 is an isometric view of a preferred embodiment of the present invention.
Figure 2:
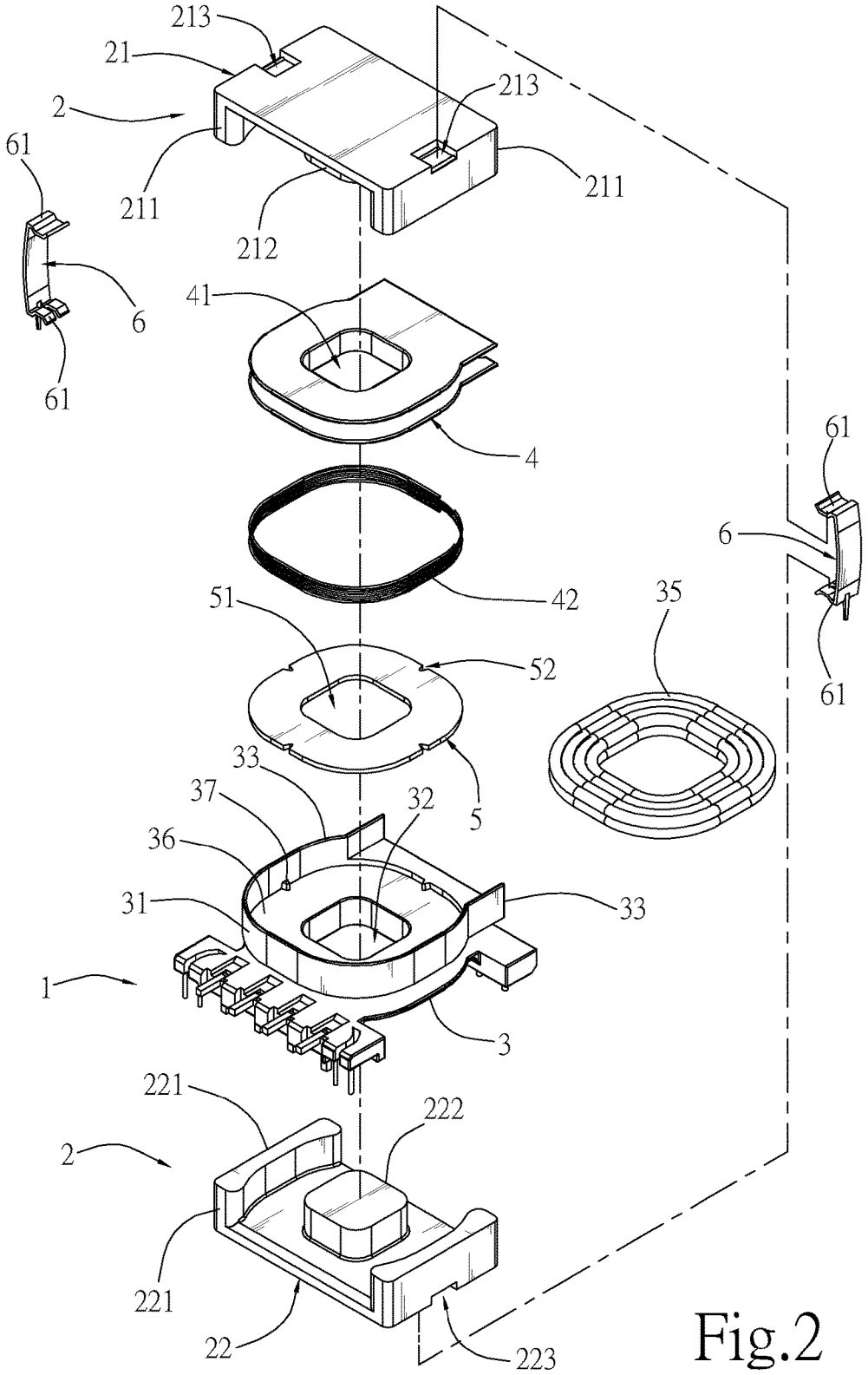
FIG. 2 is an exploded view of the preferred embodiment of the present invention.
Figure 3:
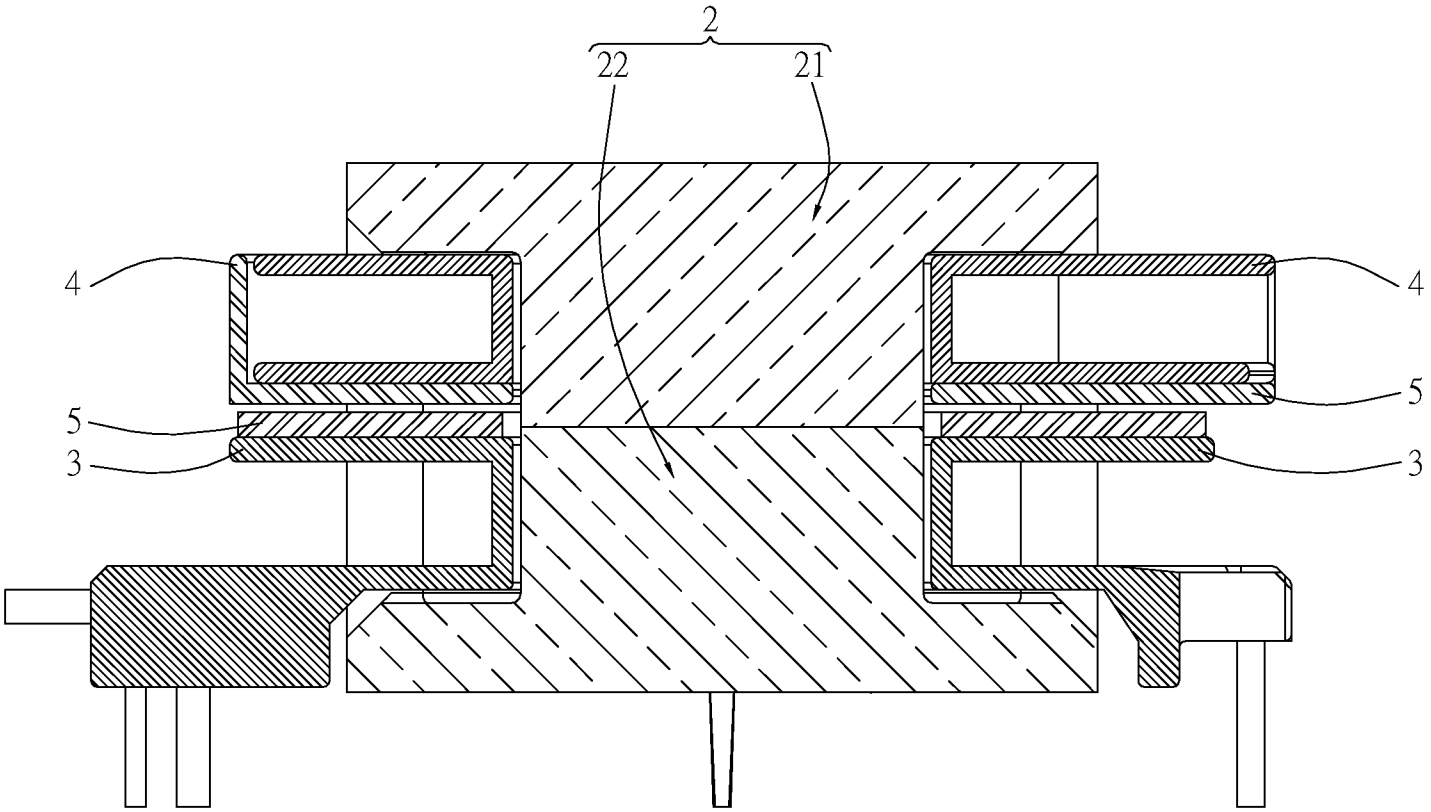
FIG. 3 is a cross-sectional view of the preferred embodiment of the present invention.

Referring to FIGS. 1-3, the structure of a resonant transformer 1 of the present invention essentially includes: a core group 2, a secondary winding group 3, a primary winding group 4, a magnetic sheet 5 and two clips 6.

The secondary winding group 3 includes a bobbin 31 having a first through hole 32. A wall plate 33 is provided around periphery of the top of the bobbin 31. A receiving space 36 is formed between the wall plate 33 and the top of the bobbin 31. A plurality of positioning columns 37 are provided at the bottom of the wall plate 33. A secondary coil 35 is wound inside the bobbin 31.

The primary winding group 4 includes a second through hole 41, which is in communication with the first through hole 32. A primary coil 42 is wound inside the primary winding group 4.

The magnetic sheet 5 includes a through hole 51, and a plurality of positioning notches 52 provided around the periphery of the magnetic sheet 5.

The core group 2 includes a first core 21 and a second core 22 symmetrically disposed. Sidewalls 211 and 221 are provided at two ends of surfaces on one side of the first and second cores 21 and 22, respectively. Protrusions 212 and 222 are disposed between the sidewalls 211 and 221, respectively. Recesses 213 and 223 are provided at two ends of surfaces on the other side of the first and second cores 21 and 22, respectively.

A hook 61 is disposed at each of two sides of each clip 6.

During assembly of the above components, the magnetic sheet 5 is placed on the bobbin 31 of the secondary winding group 3. It should be noted that "placed on" herein means that the magnetic sheet 5 can be placed on top of the bobbin 31 or inside the bobbin 31, or a plurality of magnetic sheets 5 are placed both on top and inside the bobbin 31. In this embodiment, the magnetic sheet 5 is placed inside the receiving space 36 of the bobbin 31. Next, the primary winding group 4 is placed inside the receiving space 36 and stacked on top of the magnetic sheet 5. The positioning columns 37 of the wall plate 33 are inserted in the positioning notches 52 around the magnetic sheet 5, so that the magnetic sheet 5 is secured inside the receiving space 36. As such, the through hole 51 of the magnetic sheet 5, the first through hole 32 of the secondary winding group 3 and the second through hole 41 of the primary winding group 4 are in communication with each other. The first core 21 is disposed on top of the primary winding group 4, while the second core 22 is disposed at the bottom of the primary winding group 4, meanwhile the sidewalls 211 and 221 of the first and second cores 21 and 22 covering the two sides of the secondary winding group 3, and the protrusions 212 and 222 of the first and second cores 21 and 22 passing through the first through hole 32, the second through hole 41 and the through hole 51, the core group 2 thus forms a complete magnetic path. It should be noted that in addition to connecting the first and second cores 21 and 22 by adhesive, the hooks 61 at either side of the clip 6 can be used to engage with the recesses 213 and 223 of the first and second cores 21 and 22, respectively, in order to facilitate the dismantling of the resonant transformer 1 for different magnetic sheets 5 with through holes 51 of different aperture.

Magnetic flux that is connected with both the primary and secondary coils in a transformer is called the mutual flux (or main flux $\Phi 12$ or $\Phi 21$). In addition to this, there are primary leakage flux connected with only the primary but not the secondary coil (or self magnetic flux $\Phi\sigma 1$), and secondary leakage flux connected with only the secondary but not the primary coil (or $\Phi\sigma 2$). Since there is magnetic leakage in the transformer, leakage flux must exist. Moreover, as leakage flux is only connected with one of the primary and secondary coils, this implies that the inductance of each winding is included in its respective winding. Therefore, the primary leakage flux is the primary leakage inductance, and the secondary leakage flux is the secondary leakage inductance.

Let the coupling coefficient be k, the self inductance of the primary winding be L1, the self inductance of the secondary winding be L2, then the leakage inductances of the windings are:

$$Le1(1-k)\cdot L1$$

$$Le2(1-k)\cdot L2$$

The resonant transformer 1 of the present invention has different objective from a conventional transformer, it is characterized in that the leakage inductance can be stepless fine-tuned, and the magnitude of which can be designed entirely according to needs. The coupling coefficient is the key parameter that determines the magnitude of the leakage inductance. The coupling coefficient, in a circuit, represents the level of coupling between elements, and the ratio of actual mutual inductance (absolute value) and the maximum between two inductors is defined as the coupling coefficient. Therefore, by incorporating the magnetic sheet 5 in the resonant transformer 1 of the present invention, the coupling coefficient between the secondary coil 35 and the primary coil 42 can be changed using the magnetic sheet 5. In a conventional transformer, magnetic leakage between the primary and secondary sides surrounds the coils, creating large eddy current loss. The magnetic sheet 5 is permeable, so magnetic leakage is guided back to the core. This eliminates any eddy current loss, thus greatly improving efficiency.

Figure 6:
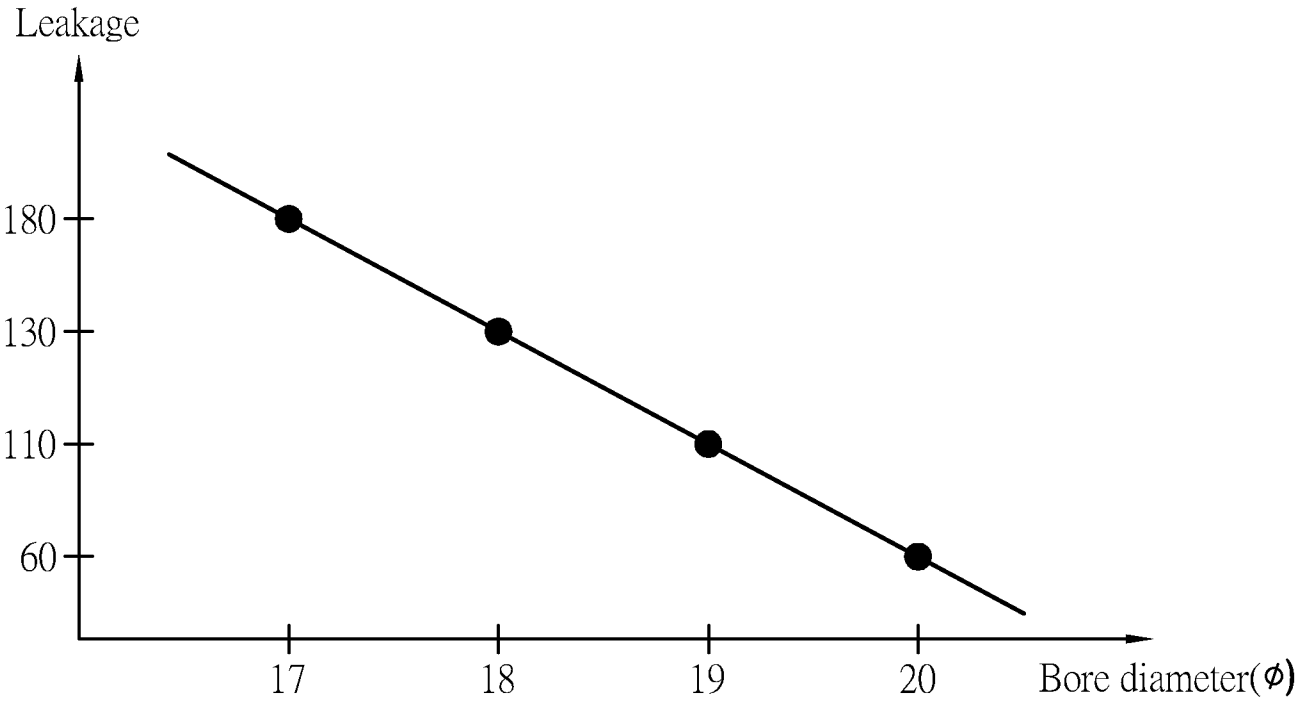
FIG. 6 is a graph of leakage inductances and magnetic sheets of a preferred embodiment of the present invention.

The magnetic sheet 5 is placed in the bobbin 3 of the secondary winding group 3, so that during operation of the resonant transformer 1, leakage inductance is produced due to magnetic interference of the magnetic sheet 5. The relationship between the leakage inductance created in the resonant transformer 1 and the magnetic sheet 5 is shown in FIG. 6. It can been seen that the aperture of the through hole 51 of the magnetic sheet 5 is inversely proportional to the leakage inductance created in the resonant transformer 1. That is, the larger the through hole 51, the smaller the leakage inductance created in the resonant transformer 1, and vice versa. In addition to the aperture of the through hole 51, the thickness of the magnetic sheet 5 is proportional to the leakage inductance created in the resonant transformer 1, and the permeability of the magnetic sheet 5 is proportional to the leakage inductance created in the resonant transformer 1. When no magnetic sheet 5 is present in the resonant transformer 1, the leakage inductance created in the resonant transformer 1 is very small, and the transformer can be used as a demagnetizing transformer.

Figure 4:
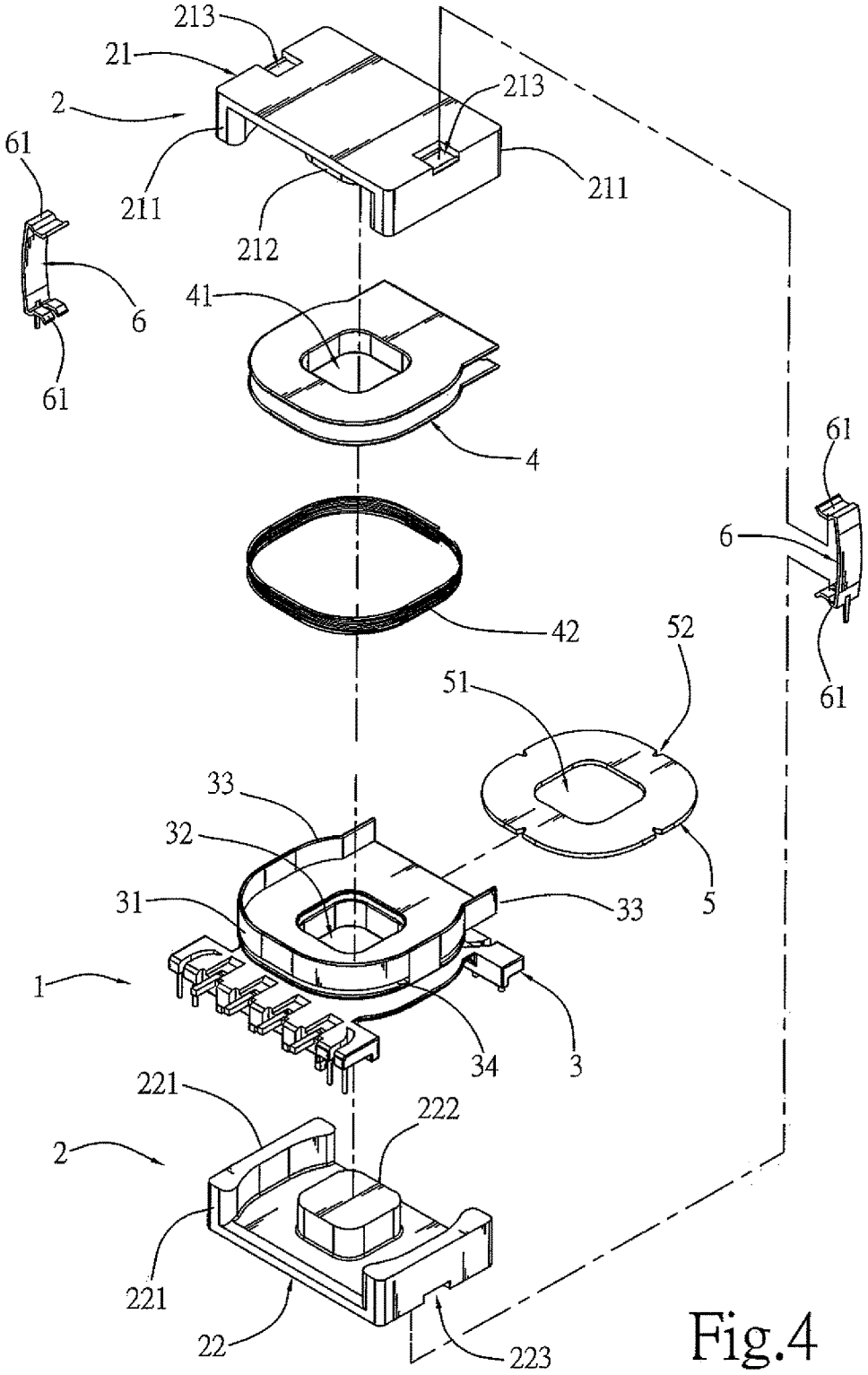
FIG. 4 is an exploded view of another preferred embodiment of the present invention.
Figure 5:
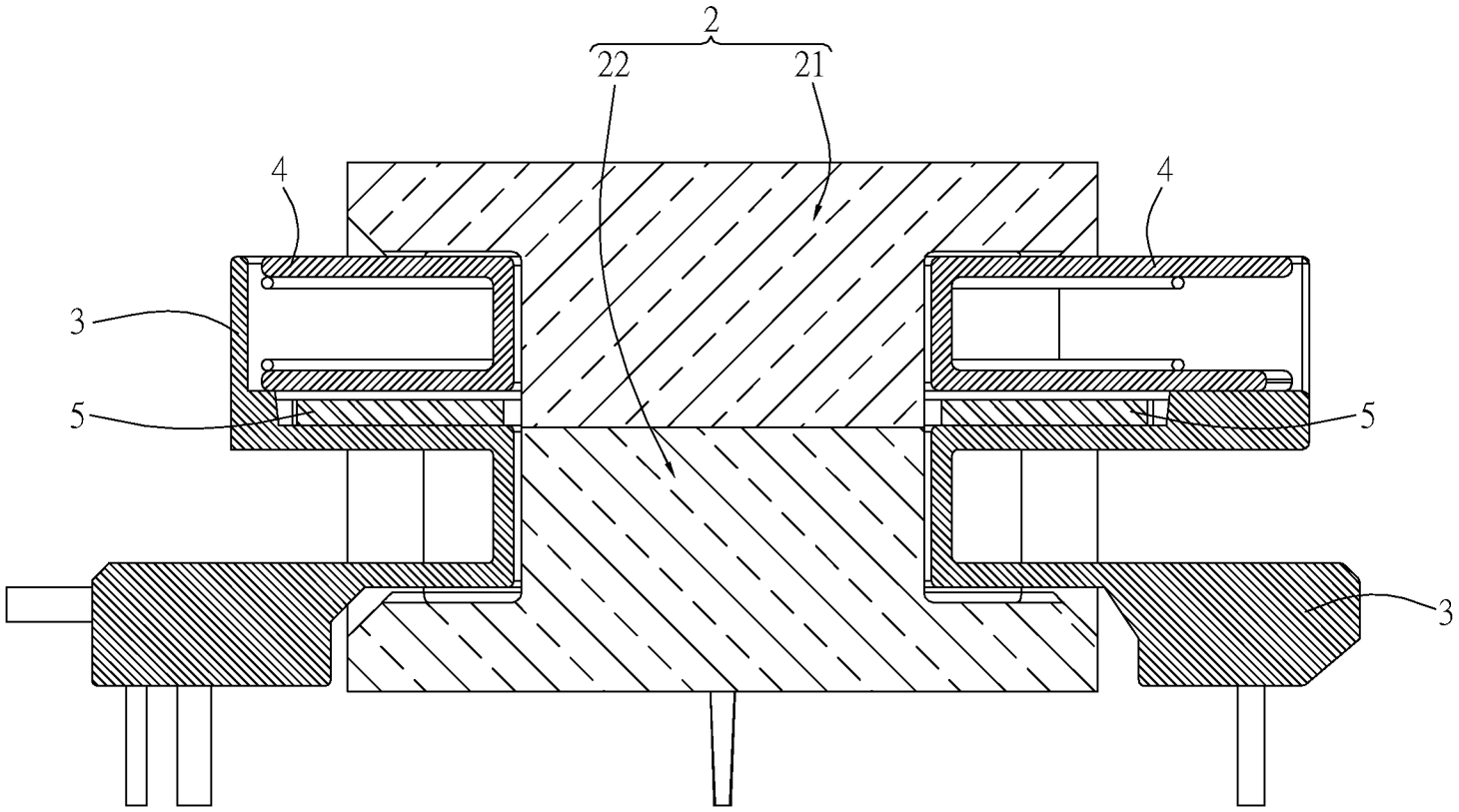
FIG. 5 is a cross-sectional view of the another preferred embodiment of the present invention.

Referring to FIGS. 4 and 5, an exploded view and a cross sectional view of a resonant transformer in accordance with another embodiment of the present invention are shown. Compared to the previous embodiment shown in FIGS. 1 to 3, this embodiment is characterized in that a slot 34 is provided in the bobbin 31 of the secondary winding group 3. A plurality of positioning columns 37 are provided inside the slot 34. The magnetic sheet 5 can be inserted into the slot 34. In addition to the previous embodiments, a plurality of magnetic sheets 5 can be provided with the secondary winding group 3. In a case that combines both of the previous two embodiments, a receiving space 36 is provided on top of and a slot 34 is provided inside the bobbin 31 of the secondary winding group 3, and positioning columns 37 are disposed in the receiving space 36 and the slot 34. This is so that in the case where greater leakage inductance is needed, a plurality of magnetic sheets 5 can be placed in the receiving space 36 and the slot 34, allowing the resonant transformer 1 to create larger leakage inductance.

In view of this, of present invention is submitted to be novel and non-obvious and a patent application is hereby filed in accordance with the patent law. It should be noted that the descriptions given above are merely descriptions of preferred embodiments of the present invention, various changes, modifications, variations or equivalents can be made to the invention without departing from the scope or spirit of the invention. It is intended that all such changes, modifications and variations fall within the scope of the following appended claims and their equivalents.

What is claimed is:

1. A resonant transformer with adjustable leakage inductance comprising:

a secondary winding group including a bobbin having a first through hole;

a primary winding group provided on the bobbin of the secondary winding group including a second through hole in communication with the first through hole;

a magnetic sheet provided in the bobbin of the secondary winding group including a through hole in communication with the first and second through holes; and a core group including a first core and a second core symmetrically disposed, the first core being disposed on the top of the primary winding group, the second core being disposed at the bottom of the primary winding group, wherein the primary winding group is provided on the secondary winding group, and after the first and second cores are disposed on the top and bottom, during operation of the resonant transformer, leakage inductance of a required magnitude is created by the magnetic sheet;

wherein a wall plate is provided around the periphery of the top of the bobbin of the secondary winding group, a receiving space is formed between the wall plate and the top of the bobbin, the magnetic sheet and the primary winding group are received in the receiving space;

wherein a plurality of positioning columns are provided at the bottom of the wall plate, and a plurality of positioning notches are correspondingly provided around the periphery of the magnetic sheet.

2. The resonant transformer with adjustable leakage inductance of claim 1, wherein a sidewall is provided at each of two ends on one side of each of the first and second cores, a protrusion is disposed between the sidewalls of each of the first and second cores, and the protrusions penetrate the first through hole, the second through hole and the through hole.

3. The resonant transformer with adjustable leakage inductance of claim 1, further comprising two clips, each of which including a hook at each of two ends thereof, and a recess being provided at each of two ends on the other side of each of the first and second cores, wherein the hooks of the clips are engaged with the recesses of the first and second cores.

4. The resonant transformer with adjustable leakage inductance of claim 1, wherein the aperture of the through hole of the magnetic sheet is inversely proportional to the leakage inductance created in the resonant transformer; the thickness of the through hole of the magnetic sheet is proportional to the leakage inductance created in the resonant transformer; and the permeability of the through hole of the magnetic sheet is proportional to the leakage inductance created in the resonant transformer.

5. A resonant transformer with adjustable leakage inductance comprising:

a secondary winding group including a bobbin having a first through hole;

a primary winding group provided on the bobbin of the secondary winding group including a second through hole in communication with the first through hole;

a magnetic sheet provided in the bobbin of the secondary winding group including a through hole in communication with the first and second through holes; and a core group including a first core and a second core symmetrically disposed, the first core being disposed on the top of the primary winding group, the second core being disposed at the bottom of the primary winding group, wherein the primary winding group is provided on the secondary winding group, and after the first and second cores are disposed on the top and bottom, during operation of the resonant transformer, leakage inductance of a required magnitude is created by the magnetic sheet;

wherein a slot is provided in the bobbin of the secondary winding group, and the magnetic sheet is disposed inside the slot;

wherein a plurality of positioning columns are provided inside the slot, and a plurality of positioning notches are correspondingly provided around the periphery of the magnetic sheet.

6. A resonant transformer with adjustable leakage inductance comprising:

a secondary winding group including a bobbin having a first through hole;

a primary winding group provided on the bobbin of the secondary winding group including a second through hole in communication with the first through hole;

a magnetic sheet provided in the bobbin of the secondary winding group including a through hole in communication with the first and second through holes; and a core group including a first core and a second core symmetrically disposed, the first core being disposed on the top of the primary winding group, the second core being disposed at the bottom of the primary winding group, wherein the primary winding group is provided on the secondary winding group, and after the first and second cores are disposed on the top and bottom, during operation of the resonant transformer, leakage inductance of a required magnitude is created by the magnetic sheet;

wherein a wall plate is provided around the periphery of the top of the bobbin of the secondary winding group, a receiving space is formed between the wall plate and the top of the bobbin, and a slot is provided in the bobbin of the secondary winding group, and the magnetic sheet is disposed inside the slot and the receiving space;

wherein a plurality of positioning columns are provided at the bottom of the wall plate and inside the slot, and a plurality of positioning notches are correspondingly provided around the periphery of the magnetic sheet.

* * * * *